US010213663B2

(12) United States Patent
Goudarzi et al.

(10) Patent No.: US 10,213,663 B2
(45) **Date of Patent: *Feb. 26, 2019**

(54) CG HEIGHT ADJUSTABILITY BY CONFORMAL WEIGHTING

(71) Applicant: Callaway Golf Company, Carlsbad, CA (US)

(72) Inventors: Tim Goudarzi, San Marcos, CA (US); Steven M. Ehlers, Poway, CA (US); Matthew Myers, Carlsbad, CA (US); Larry Tang, Carlsbad, CA (US); Wee Joung Kim, Vista, CA (US); Philip G. Foster, Vista, CA (US); Wayne H. Byrne, Murietta, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/990,265

(22) Filed: May 25, 2018

(65) Prior Publication Data

US 2018/0272203 A1 Sep. 27, 2018

Related U.S. Application Data

(60) Continuation of application No. 15/262,300, filed on Sep. 12, 2016, now Pat. No. 9,981,165, which is a (Continued)

(51) Int. Cl.
*A63B 53/06* (2015.01)
*A63B 53/04* (2015.01)
(Continued)

(52) U.S. Cl.
CPC ..... *A63B 53/0466* (2013.01); *A63B 60/52* (2015.10); *A63B 60/54* (2015.10); (Continued)

(58) Field of Classification Search
CPC ..... A63B 53/0466; A63B 60/52; A63B 60/54; A63B 2053/045; A63B 2053/0433; (Continued)

(56) References Cited

U.S. PATENT DOCUMENTS 4,085,934 A * 4/1978 Churchward ..... A63B 53/04 473/338
5,154,424 A * 10/1992 Lo ..... A63B 53/04 473/338

(Continued)

FOREIGN PATENT DOCUMENTS

JP 2002052100 A * 2/2002

*Primary Examiner* — Stephen L Blau
(74) *Attorney, Agent, or Firm* — Rebecca Hanovice; Michael Catania; Sonia Lari

(57) ABSTRACT

A golf club head comprising a conformal weight sized to fit within a recess or channel disposed in a crown or sole is disclosed herein. In some embodiments, the crown or sole itself is a conformal weight, and is removably affixed to a base structure comprising a striking face and a skeletal support structure. In other embodiments, the golf club head comprises a conformal weight in the form of a sole cap that is removably affixed to the golf club head and covers small weight ports disposed in the sole.

14 Claims, 11 Drawing Sheets

Related U.S. Application Data division of application No. 14/755,853, filed on Jun. 30, 2015, now Pat. No. 9,463,361, which is a division of application No. 14/162,633, filed on Jan. 23, 2014, now Pat. No. 9,101,811, which is a continuation-in-part of application No. 14/151,148, filed on Jan. 9, 2014, now Pat. No. 9,022,881, which is a continuation-in-part of application No. 14/050,194, filed on Oct. 9, 2013, now Pat. No. 8,690,708, which is a continuation-in-part of application No. 13/797,404, filed on Mar. 12, 2013, now abandoned.

(60) Provisional application No. 61/892,380, filed on Oct. 17, 2013, provisional application No. 61/657,247, filed on Jun. 8, 2012.

(51) Int. Cl.
*A63B 60/52* (2015.01)
*A63B 60/54* (2015.01)

(52) U.S. Cl.
CPC . *A63B 2053/045* (2013.01); *A63B 2053/0433* (2013.01); *A63B 2053/0437* (2013.01); *A63B 2053/0441* (2013.01); *A63B 2053/0491* (2013.01); *A63B 2209/00* (2013.01); *A63B 2209/02* (2013.01)

(58) Field of Classification Search
CPC .... A63B 2053/0437; A63B 2053/0441; A63B 2209/00; A63B 2209/02
See application file for complete search history.

(56) References Cited

U.S. PATENT DOCUMENTS

| | | | | | |
|---|---|---|---|---|---|
| 5,251,901 | A * | 10/1993 | Solheim | A63B 53/04 | 473/338 |
| 7,128,662 | B2 * | 10/2006 | Kumamoto | A63B 53/0466 | 473/345 |
| 7,153,220 | B2 * | 12/2006 | Lo | A63B 53/04 | 473/335 |
| 7,217,199 | B2 * | 5/2007 | Nakahara | A63B 53/04 | 473/329 |
| 2001/0011044 | A1 * | 8/2001 | Galy | A63B 53/04 | 473/324 |
| 2013/0178305 | A1 * | 7/2013 | Beno | A63B 60/00 | 473/287 |
| 2014/0221125 | A1 * | 8/2014 | Day | A63B 60/46 | 473/343 |
| 2018/0200586 | A1 * | 7/2018 | Stites | A63B 53/04 | |

* cited by examiner

CG HEIGHT ADJUSTABILITY BY CONFORMAL WEIGHTING

CROSS REFERENCES TO RELATED APPLICATIONS

The present application claims priority to and is a continuation of U.S. patent application Ser. No. 15/262,300, filed on Sep. 12, 2016, and issued on May 29, 2018, as U.S. Pat. No. 9,981,165, which is a division of U.S. patent application Ser. No. 14/755,853, filed on Jun. 30, 2015, and issued on Oct. 11, 2016, as U.S. Pat. No. 9,463,361, which is a division of U.S. patent application Ser. No. 14/162,633, filed on Jan. 23, 2014, and issued on Aug. 11, 2014, as U.S. Pat. No. 9,101,811, which claims priority to U.S. Provisional Patent Application No. 61/892,380, filed on Oct. 17, 2013, and is a continuation in part of U.S. patent application Ser. No. 14/151,148, filed on Jan. 9, 2014, and issued on May 15, 2015, as U.S. Pat. No. 9,022,881, which is a continuation in part of U.S. patent application Ser. No. 14/050,194, filed on Oct. 9, 2013, and issued on Apr. 8, 2014, as U.S. Pat. No. 8,690,708, which is a continuation in part of U.S. patent application Ser. No. 13/797,404, filed on Mar. 12, 2013, now abandoned, which claims priority to U.S. Provisional Patent Application No. 61/657,247, filed on Jun. 8, 2012, the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a golf club head. More specifically, the present invention relates to a conformal weight for a golf club head.

Description of the Related Art

Relatively little has been done with the placement of adjustable weights directly in the crowns of drivers. Positioning weights in a crown, especially near its highest point, is very effective in moving the vertical position of the center of gravity, and also is useful for controlling golf ball backspin, allowing the vertical component of golf ball trajectory to be optimized for different head speeds, swing styles and player preference. Unfortunately, achieving sufficient center of gravity range is difficult, such installations are visually distracting at address, the fixed structure of a weight port is inefficient and penalizes overall performance, and a concentrated mass located in the center of the crown can have an adverse effect on impact sound. Furthermore, impact sound may be noticeably different for different weighting configurations.

There are ways to deal with the appearance of a weight in the center of the crown. For instance, it is possible to cover the weight port with a medallion or cover piece. Unfortunately, this adds to the fixed portion of the adjustable weighting system mass and further detracts from its efficiency. The cover can also become a source of buzzing or can become detached and possibly lost. Mitigating such impact sound effects typically requires stiffeners, an increase in crown thickness, or both. Both of these approaches add to the fixed structural weight of the crown and tend to increase the center of gravity height.

Weight ports in the crown that are visible at address are not desirable. They are potentially distracting and can impact cosmetic appearance. In addition, the weight port structure adds to total crown mass. This additional fixed crown mass raises center of gravity of the head and provides little contribution to other important characteristics such as moment of inertia. In a typical weight port configuration the weight is contained within the outer mold line of the head. For a crown weight this means that its position is lower than ideal, thus reducing the achievable vertical center of gravity range.

BRIEF SUMMARY OF THE INVENTION

The objective of this invention is to provide a thin, adjustable weight with minimal or no effect on appearance at address while maximizing the ability of the weight to adjust center of gravity height. Additional goals include minimizing the fixed component of the structure dedicated to the weighting system and also minimizing any potential effect on impact sound.

One aspect of the present invention is a golf club head comprising a face component comprising a striking surface, a crown, a sole, a conformal weight, and a damping layer, wherein at least one of the crown and the sole comprises a shallow recess sized to releasably receive the conformal weight, and wherein the damping layer is disposed between the shallow recess and the conformal weight. In some embodiments, the conformal weight may comprise a polygonal shape, or may be faceted. In other embodiments, the conformal weight may comprise a polymer having a specific gravity value of 1.8 to 4.2. In some embodiments, the shallow recess may be disposed at a rear portion of the sole. In other embodiments, the conformal weight may be affixed within the shallow recess with a fastener selected from the group consisting of a mechanical fastener, a semi-permanent adhesive, and an edge support structure. In yet another embodiment, the golf club head may further comprise a secondary weight, which may be disposed beneath the conformal weight when the conformal weight is engaged with the recess.

Another aspect of the present invention is a golf club head comprising a base structure comprising a striking face and a skeletal support structure extending away from the striking face, a crown composed of a lightweight material, and a sole composed of a lightweight material, wherein at least one of the crown and the sole is removably affixed to the skeletal support structure, and wherein the skeletal support structure comprises at least one shallow weight port. In some embodiments, the skeletal support structure may comprise a first shallow weight port disposed proximate the crown, and second shallow weight port disposed proximate the sole. In a further embodiment, at least one of the crown and the sole may comprise a protrusion extending from an internal surface, and the protrusion may at least partially fill one of the first and second shallow weight ports when the crown or sole is affixed to the base structure. In a further embodiment, the golf club head may comprise a conformal weight that may be secured within at least one of the first and second shallow weight ports by the protrusion.

In another embodiment, the golf club head may further comprise at least one conformal weight sized to fit within the at least one shallow weight port, and the at least one conformal weight may be removably received by the at least one shallow weight port. In another embodiment, the lightweight material may be a composite material, and the base structure may be composed of a metal alloy. In yet another embodiment, at least one of the crown and the sole may be removably affixed to the skeletal support structure with a screw fastener. In another embodiment, the at least one shallow weight port may be integrally formed with the skeletal support structure.

Yet another aspect of the present invention is a golf club head comprising a body comprising a crown, a face, and a sole, a sole cap comprising a central region having an opening and a first arm, a second arm, and a third arm extending from the central region, and at least one weight slug, wherein the sole comprises a central region with a protrusion sized to fit within the opening and at least one weight port sized to receive the at least one weight slug, wherein the sole cap is removably affixed to the sole with a fastener, and wherein the at least one weight port is covered by one of the first arm, second arm, and third arm when the sole cap is affixed to the sole. In some embodiments, the at least one weight slug may comprise two weight slugs, and the at least one weight port may comprise at least four weight ports. In a further embodiment, each of the weight ports may be disposed proximate the protrusion. In some embodiments, the sole cap may be composed of a carbon material, and the at least one weight slug may be composed of a high-density metal alloy such as a tungsten alloy. In yet another embodiment, the golf club head may be a wood-type golf club head, such as a fairway wood or a driver.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
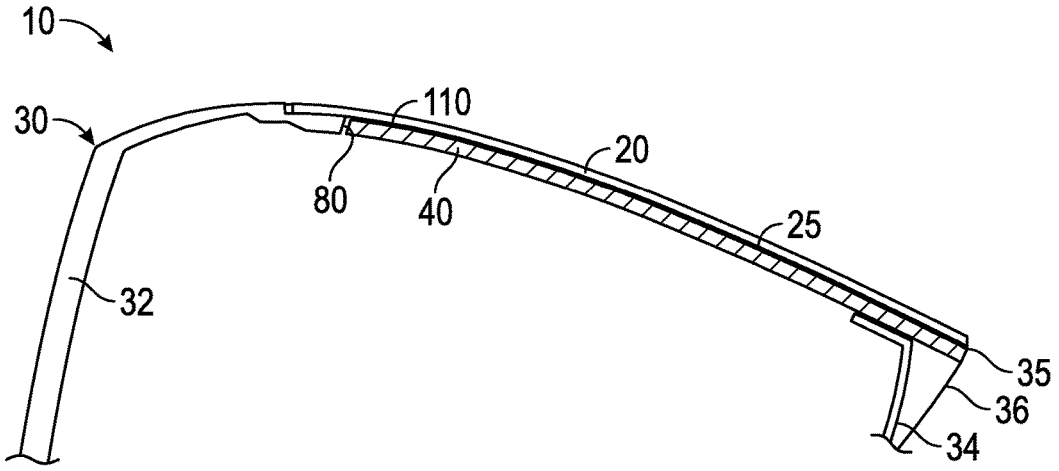
FIG. 1 is a cross-sectional view illustrating a position of a conformal weight within a golf club head.

As shown in FIG. 1, the design approach described here is based on the construction used in Callaway Golf Company's RAZR Fit driver head 10, characterized by a composite crown 20 adhesively bonded to a cast Titanium body 30, which comprises a face 32, a sole 34, and sometimes a ribbon 36. This particular construction approach permits the crown 20 configuration to be adapted to the hidden conformal weighting system 100 described herein with minimal impact to weight and function. However, this weighting system 100 may be used with other constructions including all Titanium, all composite and composite body with metal face cup. It is also intended to work in conjunction with at least one adjustable weight port on the sole of the driver head 10. Shifting weight between the crown weighting system 100 described herein and a port (not shown) located on the sole 34 allows for control of center of gravity height. In the most general case the sole 34 weighting technique will be different than the crown 20.

Figure 2:
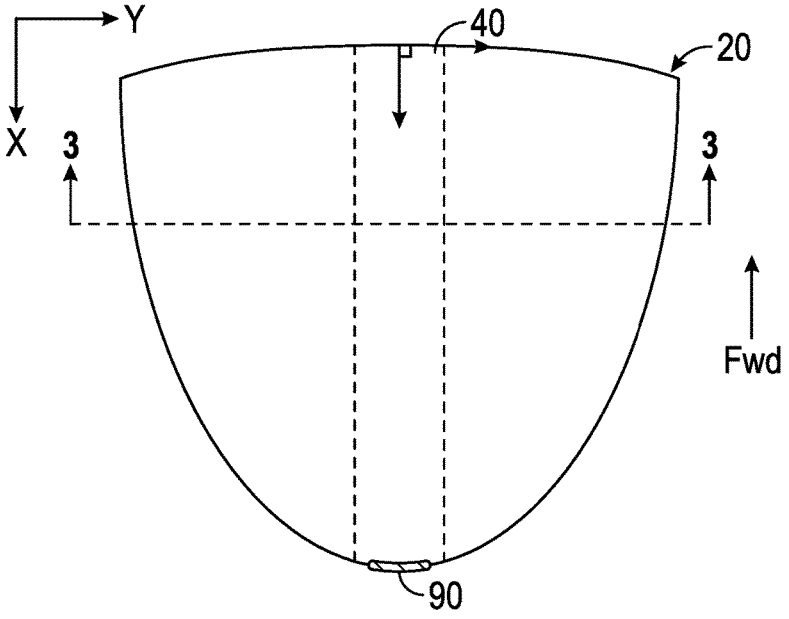
FIG. 2 is a plan view of a crown of a golf club head illustrating an orientation of a conformal weight and a local shell coordinate system.

In the primary configuration, shown in FIG. 1, the crown 20 is a doubly curved composite shallow shell structure adhesively bonded to the body 30 at its perimeter 35. The weight 40 is termed conformal in that it closely follows the crown 20 shape to maximize its height and effect on vertical center of gravity position. The conformal weight 40 preferably is oriented front to back and aligned close to the head X-axis, as shown in FIG. 2. However, the conformal weight 40 can be angled with respect to the head X-axis to accommodate performance or alignment needs without significant reduction in performance.

Figure 3A:
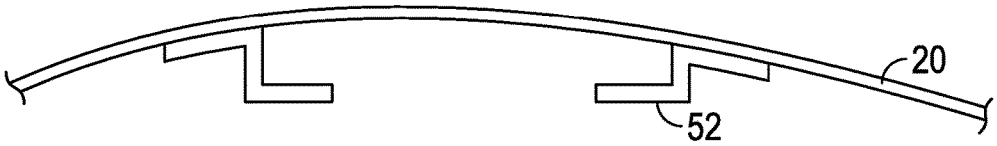
FIGS. 3A-3D illustrate cross-sectional configurations of different conformal weight installation sections on a crown of a golf club head.
Figure 3B:
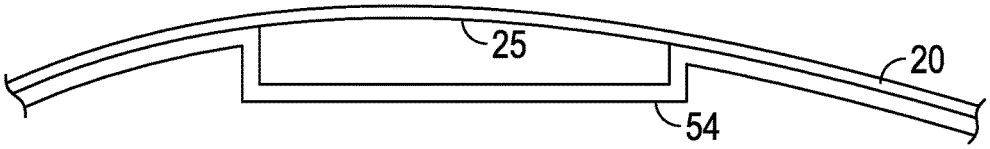
Figure 3C:
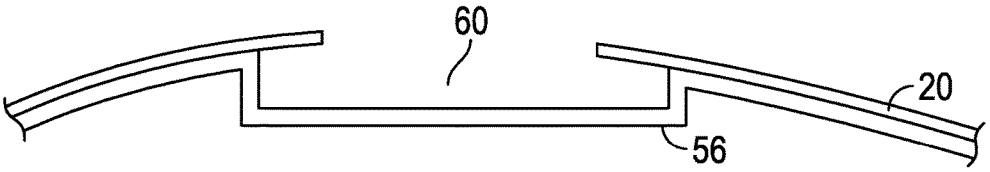
Figure 3D:
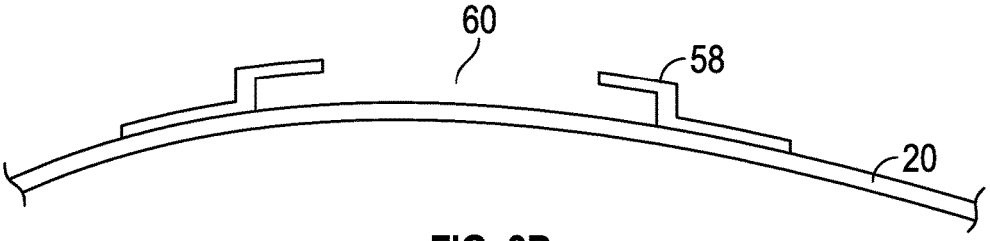

To hold the conformal weight 40, the internal surface 25 of the crown 20 is modified by the addition of edge support structures 50, oriented fore and aft and aligned essentially parallel to the head Y-axis. These support structures 50 may be integrally molded from the crown 20 parent material or be secondarily bonded to the crown 20. In the embodiment shown in FIG. 3A, the crown 20 comprises internal edge rails 52 which hold the conformal weight 40 in place. In an alternative embodiment, the crown 20 comprises an internal enclosed support structure 54, which completely sandwiches the conformal weight 40 between the support structure 54 and the internal surface 25 of the crown 20 as shown in FIG. 3B. In another embodiment, shown in FIG. 3C, the crown 20 is formed with an external channel 60 oriented fore and aft with internal edge rails 56 at the lateral edges of the channel 60 to hold the weights in place. In this approach, the conformal crown weight 40 is visually apparent, but its visual effects are minimized by finishing the conformal weight 40 in a manner identical to the surrounding crown 20. Alternatively, the conformal weight's 40 geometry and cosmetics can be intentionally configured in a manner to make it an alignment aid at address. In yet another embodiment, external edge rails 58 are formed with or added to the crown 20 as shown in FIG. 3D. A benefit of these edge support structures 50 is that they increase stiffness of the crown 20 to counteract the mass effect of the conformal weights 40, thus mitigating effects on vibrational behavior. In this manner the edge supports 50 serve two functional roles; stiffener and weight guide.

Figure 4A:
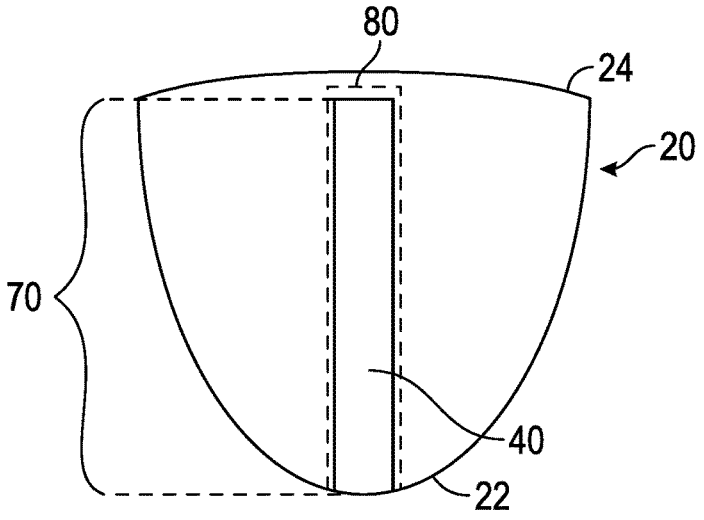
FIGS. 4A-4C illustrates multiple crowns of golf clubs with varying weight concealment ranging from fully hidden, aft section exposed, and fully exposed.
Figure 4B:
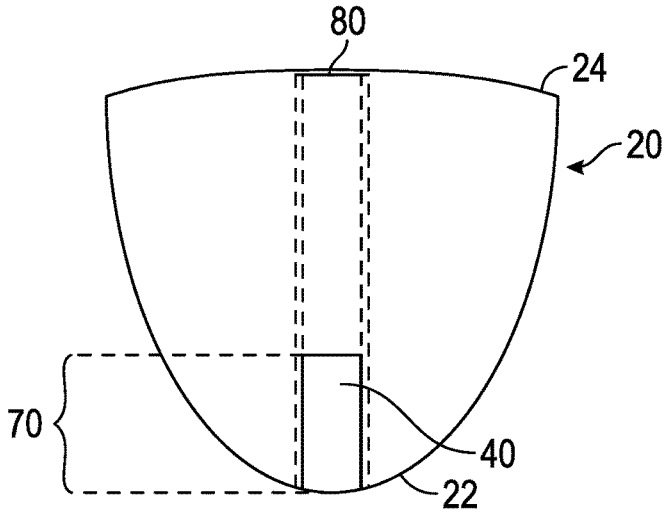
Figure 4C:
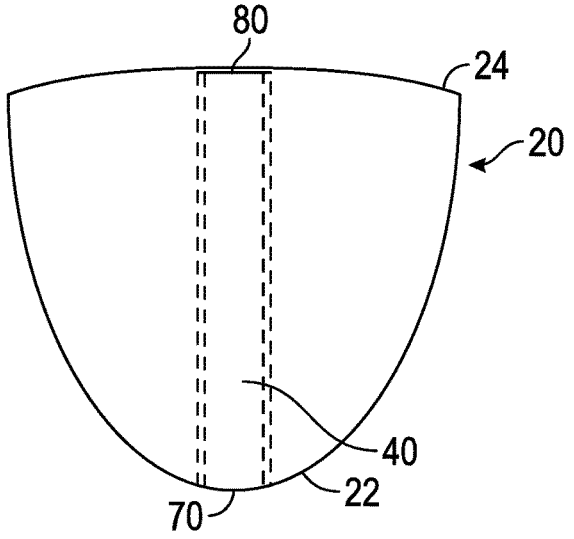

The conformal weights 40 of the present invention preferably are inserted into or removed from the crown 20 via an opening 70 at the aft edge 22 of the crown 20 or, in an alternative embodiment, via an aft section of the ribbon portion of the body (not shown). In the embodiment shown in FIG. 4A, the opening 70 extends the entire length of the crown 20 along the X-axis, thus forming an external channel 60. In the embodiment shown in FIG. 4B, the opening 70 extends approximately one third of the length of the crown 20 along the X-axis, while in FIG. 4C, the opening 70 is located entirely at the aft edge 22 of the crown 20.

Figure 5A:
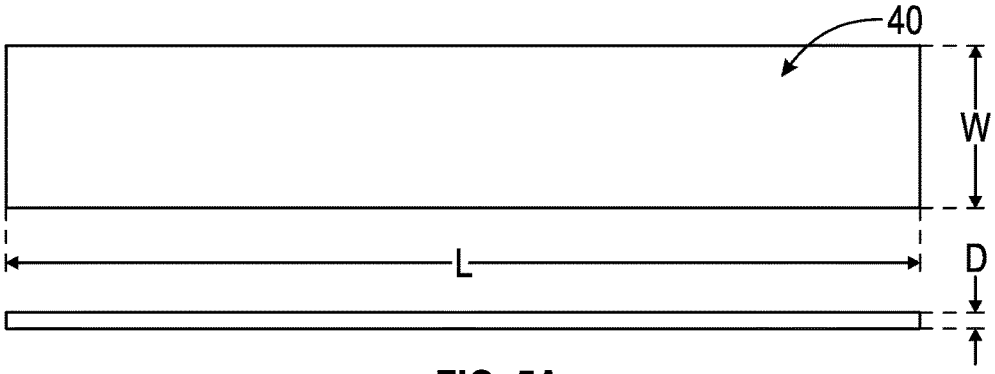
FIGS. 5A-5D illustrate multiple configuration and construction options for a flexible conformal weight for a golf club head.
Figure 5B:
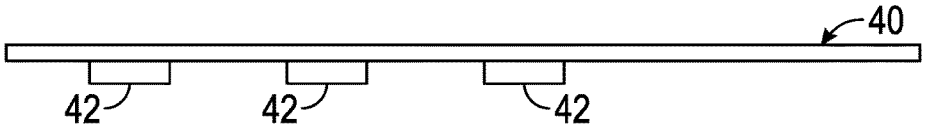
Figure 5C:
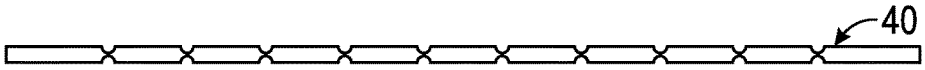
Figure 5D:
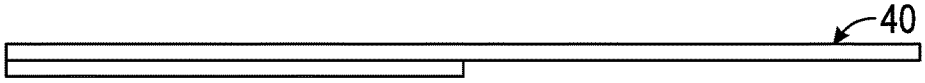

The conformal weights 40 of the present invention preferably are thin flexible elements sized to fit within the edge support structure 50 and to follow the curvature of the crown 20, though in other embodiments may be rigid and inflexible. In the embodiment shown in FIG. 5A, the conformal weight 40 is a flexible strip of material having a consistent length L, width W, and depth D. In an alternative embodiment, shown in FIG. 5B, the conformal weight 40 is a flexible strip of material having attached weight protrusions 42. In another embodiment, shown in FIG. 5C, the conformal weight 40 is segmented such that it does not have a consistent depth D. In yet another embodiment, the conformal weight 40 is laminated so that it has a variable depth D.

Figure 6A:
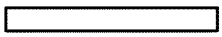
FIGS. 6A-6D illustrate multiple cross-section options for a flexible conformal weight for a golf club head.
Figure 6B:
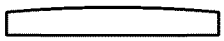
Figure 6C:
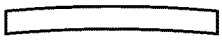
Figure 6D:
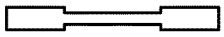

A range of weight values for the conformal weights 40 of the present invention can be achieved using loaded polymers or a polymer substrate with attached weights. High density polymers with sufficient bending flexibility exist with specific gravity values ranging from 1.8 to 4.2. Another approach is to use segmented conformal weights 40 with flexible connectors. It is also possible to attach conformal weights 40 to a flexible substrate or laminate highly loaded polymer layers to a flexible substrate. Mass distribution within the flexible weight does not have to be evenly distributed. In fact, it is beneficial to concentrate weight near the forward half of the conformal weight 40 to maximize its effect on center of gravity height. The conformal weight 40 also need not be flat, as shown in FIGS. 6A and 6B. Instead, the initial un-deformed shape of the conformal weight 40 may include a slight curvature that is similar to the crown 20 contour to reduce insertion contact forces and the resulting friction. In yet another embodiment, shown in FIG. 6D, the conformal weight 40 may have a thick-edged cross-sectional shape. In general, the cross-sectional shape of the conformal weight 40 must provide sufficient volume while maintaining flexibility to permit easy insertion and removal.

Figure 7A:
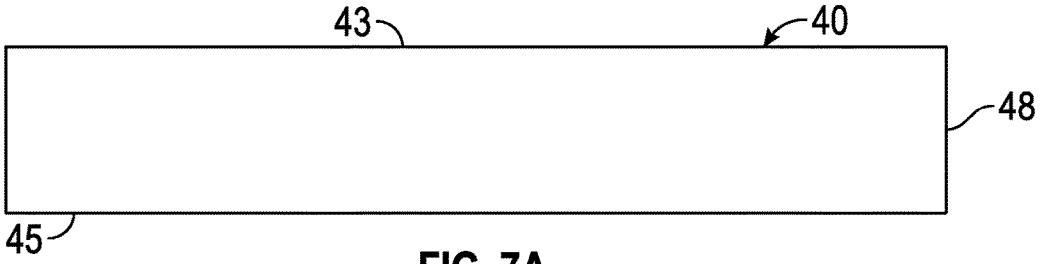
FIGS. 7A-7E illustrate multiple alternatives for a flexible conformal weight for a golf club head.
Figure 7B:
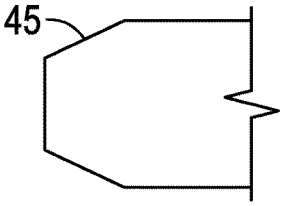
Figure 7D:
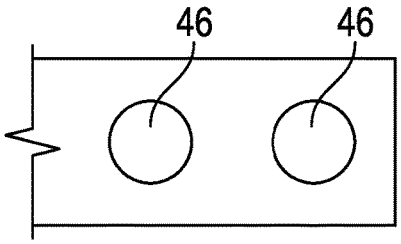
Figure 7C:
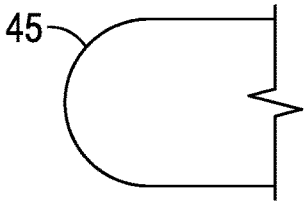
Figure 7E:
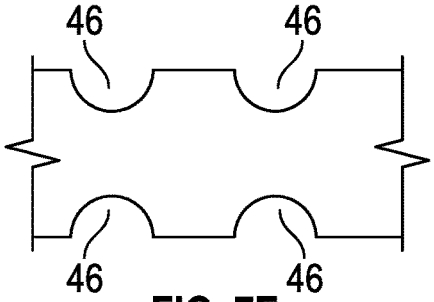

The conformal weights 40 of the present invention preferably are inserted via the aft opening 70 and move along the edge support structures 50 until the conformal weights 40 engage with a contact surface 80 disposed proximate at the forward edge of the crown 20, as shown in FIGS. 1 and 4A-4C. This allows the high loads caused by impact to be taken in bearing and transferred directly to the crown 20 structure of the face cup, if one is used. In one embodiment, the shape of the conformal weight 40 is a simple rectangle, as shown in FIG. 7. In another embodiment, the front edge 45 of the conformal weight 40 is modified with a taper, as shown in FIG. 7B, to improve engagement and alignment of the conformal weight 40 at the contact surface 80. In an alternative embodiment, the front edge 45 of the conformal weight is modified with a rounded section, as shown in FIG. 7C. Reducing weight and increasing flexibility of the conformal weight 40 is accomplished by including cutouts 46 in the center of the conformal weight 40 or along its edge 43. Minimizing vibration and buzz of the conformal weights 40 can be achieved by adding snubbers or a damping layer 110 between the weight and crown surface, but these elements must be carefully designed to avoid adding unnecessarily to the force required to insert or remove the conformal weight 40.

A fastener 90 at the aft edge 22 of the crown 20 or on the aft ribbon section as shown in FIG. 2 is used to secure the conformal weight 40 for play. The fastener 90 ideally preloads the conformal weight 40 in compression to minimize vibration and insure proper load transfer at impact. This fastener 90 location also serves as a swingweight adjustment weight, if needed. Alternatively, a snap fit or clip restraint can be used at the aft end 48 of the conformal weight 40. This is possible because the predominant load at impact is taken in compression by the front edge 45 of the conformal weight 40 near the face 32. Out of plane and lateral loads are absorbed by the edge restraint structures 50. The fastener 90 may have any of the configurations disclosed in U.S. patent application Ser. No. 14/151,148, the disclosure of which is hereby incorporated by reference in its entirety herein.

The approaches detailed herein are well suited to a composite crown 20 due to its extremely low structural weight. The composite may be a discontinuous short or long fiber molded composite or a laminated composite. It is also possible to utilize aluminum, magnesium or titanium alloy to make the crown 20. Varying the amount of weight in the crown 20 may have an effect on driver sound at impact. A relatively flexible conformal weight 40 will mass load the crown 20, thus affecting vibration modes with significant crown 20 participation. This effect can be mitigated by the use of stiff edge restraint structures 50 and matching the stiffness of the conformal weight system 100 to the local crown 20 structure.

Figure 8:
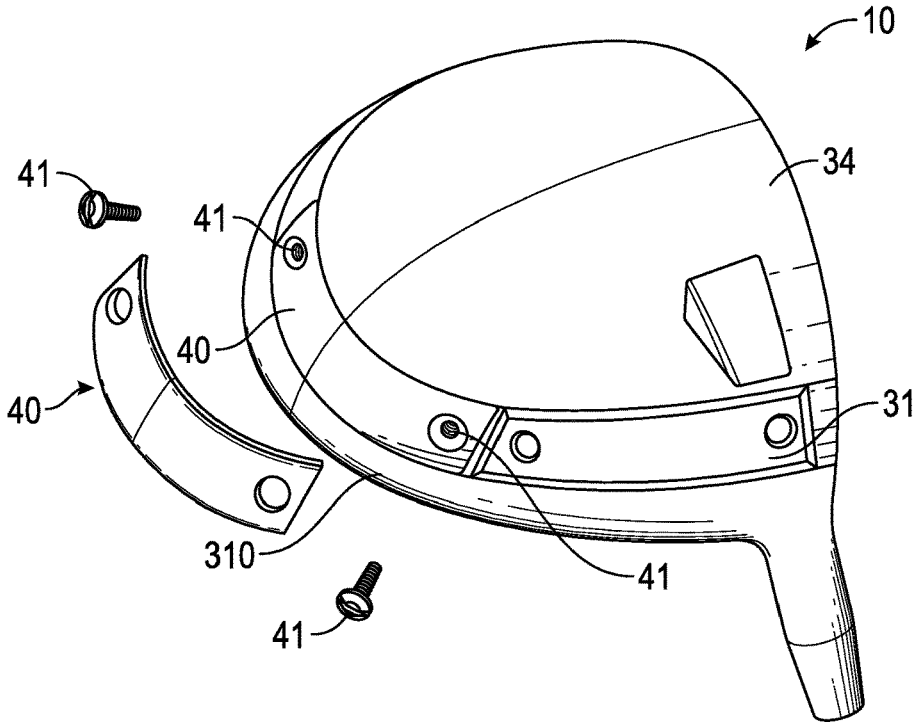
FIGS. 8-10 are views of golf club heads having different conformal weight configurations according to the present invention.
Figure 9:
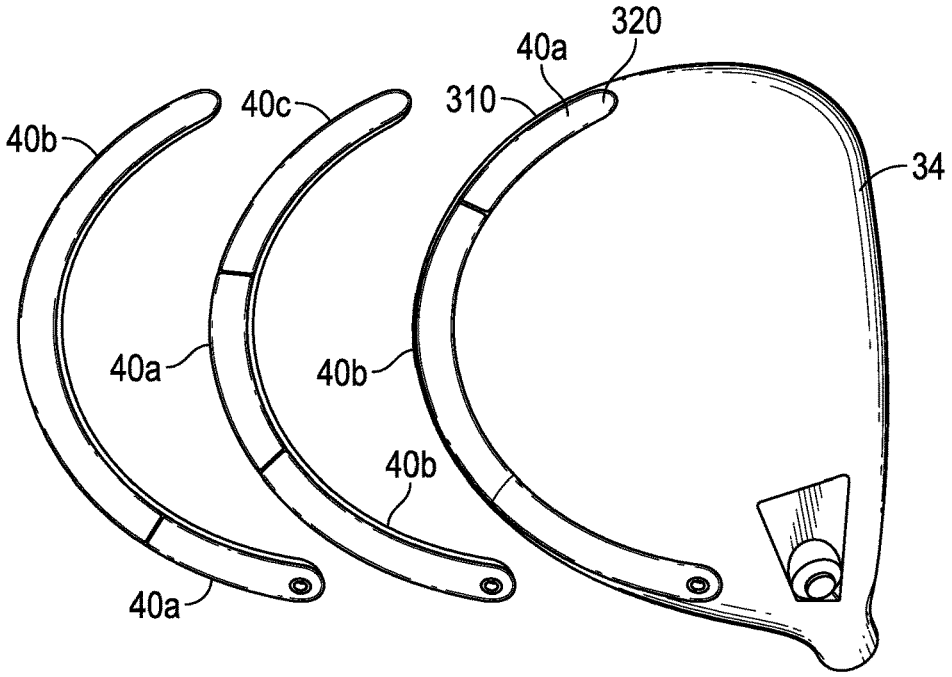
Figure 10:
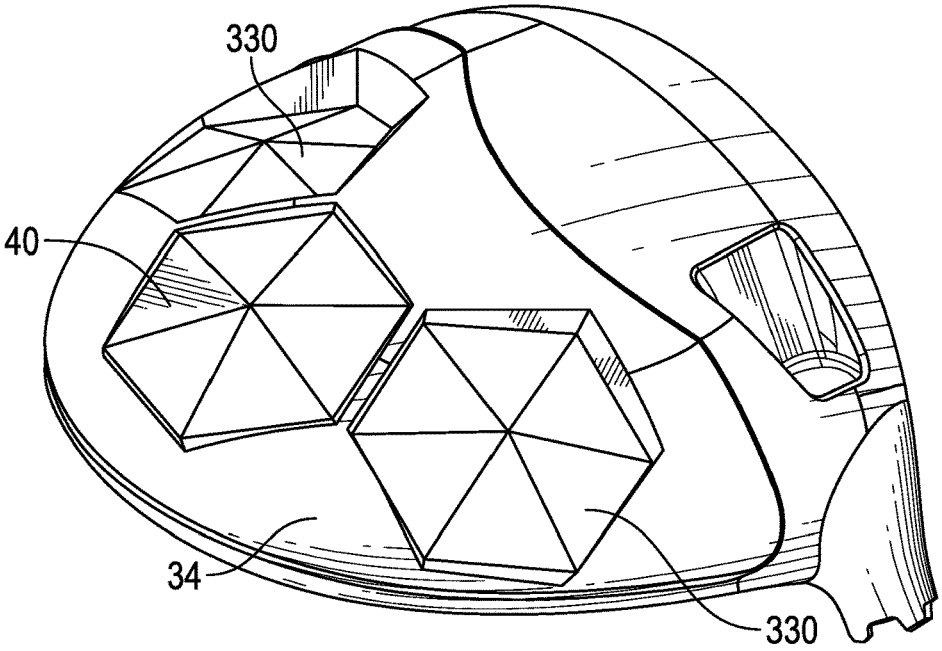

The conformal weights 40 discussed in connection with the embodiments shown in FIGS. 1-4C herein may also be affixed to the sole 34 instead of, or in addition to, a separate weight screw that can be disposed within a sole weight port. For example, as shown in FIG. 8, several conformal weights 40 are affixed to a rear portion 310 of the sole 34 or, in the case of a club having a ribbon or skirt portion (not shown), the ribbon or skirt. In the embodiment shown in FIG. 8, the conformal weights 40 are affixed within one or more shallow recesses 31 in the sole 34 with mechanical fasteners 41 (e.g., screws, snaps, or other features), but in other embodiments may be affixed as otherwise described herein (e.g., edge support structures 50 and/or channels 60). In another embodiment, shown in FIG. 9, the sole 34 comprises a shallow channel 320 extending around the rear portion 310 (or the ribbon or skirt), and the conformal weights 40, which are strip shaped, are disposed within the channel 320 in any configuration desired by a user. In this embodiment, at least one of the conformal weights 40*a* is heavier/has a higher specific gravity than the other conformal weights 40*b*, 40*c* to allow for easier adjustment of the golf club head's 10 bias and center of gravity. In this embodiment, as in the one shown in FIG. 8, the conformal weights 40*a*, 40*b*, 40*c* may affixed within the channel 320 with a mechanical fastener 41 or by another means disclosed herein. In yet another embodiment, shown in FIG. 10, the conformal weight 40 has a polygonal and faceted shape and is inserted into one of several depressions 330 with matching shapes and faceting in the sole 34. The conformal weights 40 in this and the embodiments disclosed in FIGS. 8 and 9 preferably are keyed and/or faceted so that they fit snugly within the depressions 330 or channels 320, and may be made of rigid material instead of flexible polymers. The conformal weights 40 shown in FIGS. 8-10 may also be disposed on an inside surface of the crown 20 and sole 34 instead of on the outside surface as shown in these Figures.

Figure 11A:
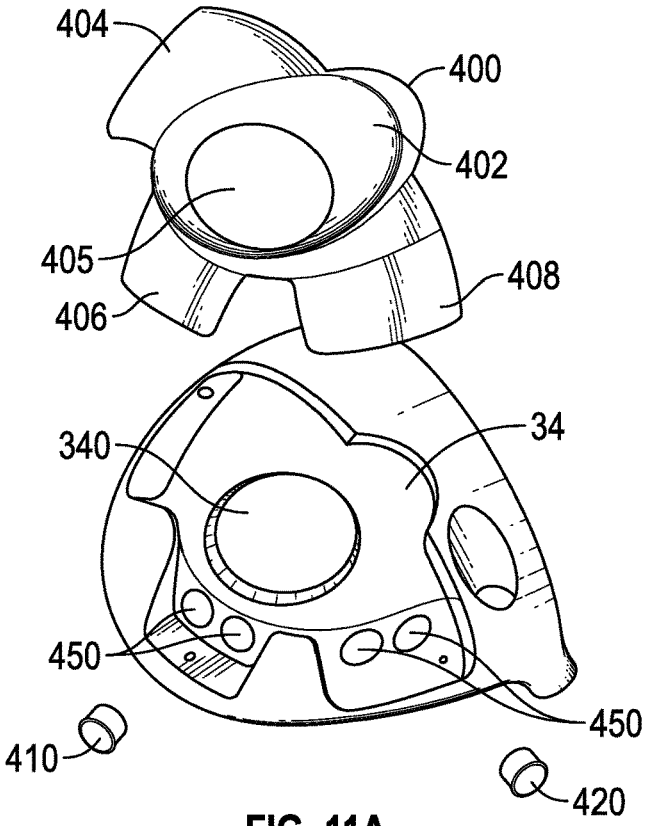
FIG. 11A is an exploded view of another embodiment of the present invention.
Figure 11B:
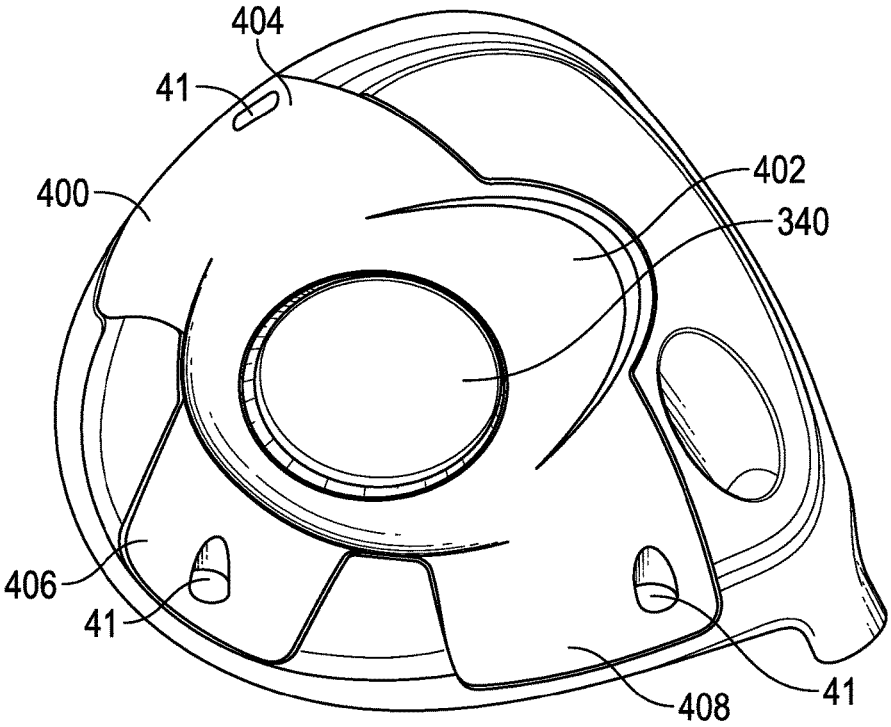
FIG. 11B is an assembled view of the embodiment shown in FIG. 11A.

In another, preferred, embodiment, shown in FIGS. 11A and 11B, the conformal weight 40 is be provided in the form of a cap 400 to which weights 410, 420 may be affixed or, as shown in these Figures, under which smaller weights 410, 420 are hidden from view. The cap 400 preferably has a clover shape, with a center region 402 and three arms 404, 406, 408 that extend across the sole 34 towards the edge portion where the crown 20 contacts the sole 34. Though this configuration is shown in combination with a sole 34 in these Figures, the cap 400 and weights 410, 420 may, in an alternative embodiment, be engaged with the crown 20. In this embodiment, the sole 34 comprises a plurality of small weight ports 450 sized to releasably receive the weights 410, 420, and the cap 400 is removably affixed to the sole 34 with three mechanical fasteners 41 and includes a central opening 405 that receives a protrusion 340 extending from the sole 34 to help orient the cap 400 when it is being affixed to the sole 34. In an alternative embodiment, the central opening 405 grips the protrusion 340 tightly enough to make the use of fasteners 41 unnecessary. In another alternative embodiment, the weights 410, 420 may serve to affix the cap 400 to the sole 34. In a further embodiment, the cap 400 may be made of a lightweight material such as composite and may not have any weights affixed to it, while the weights 410, 420 may be composed of a high-density material such as tungsten alloy. In another embodiment, the cap 400 may not be conformal weight 40 itself, but may have any of the conformal weights 40 disclosed herein attached to it.

Figure 12A:
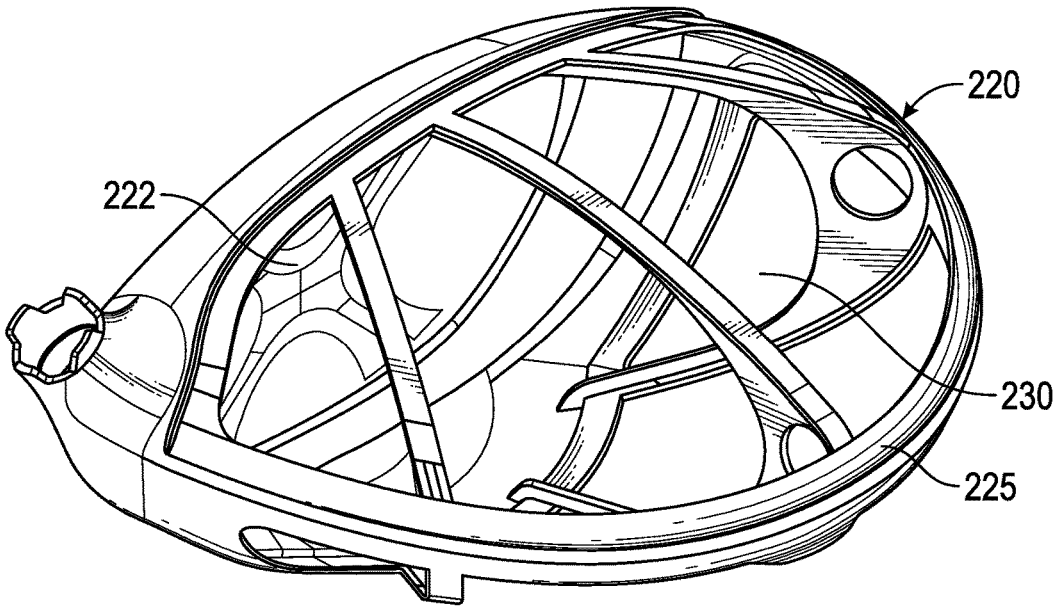
FIG. 12A is a top perspective view of a skeletal golf club head according to another embodiment of the present invention.
Figure 12B:
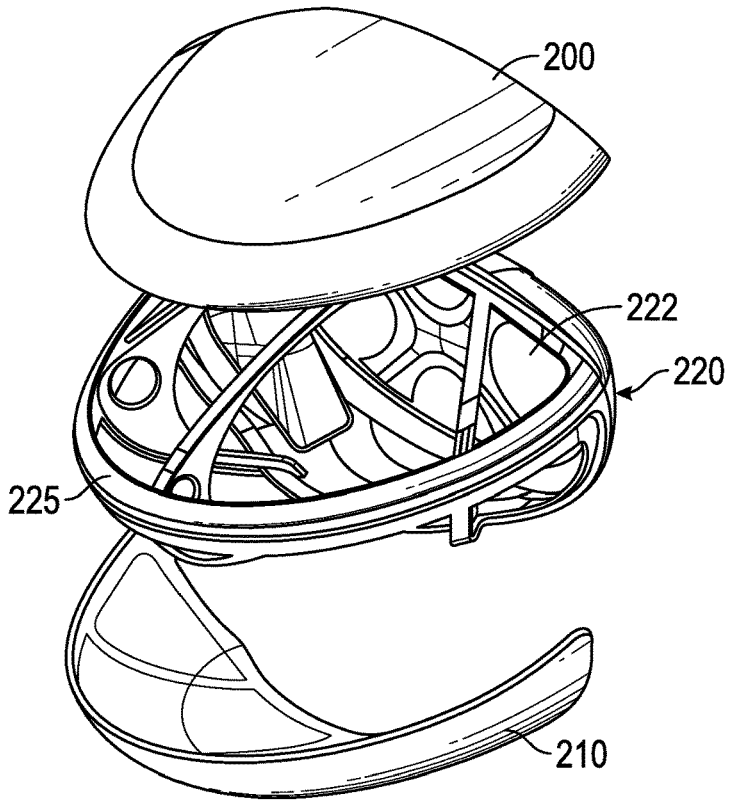
FIG. 12B is an exploded view of the golf club shown in FIG. 12A with crown and sole shells.
Figure 12C:
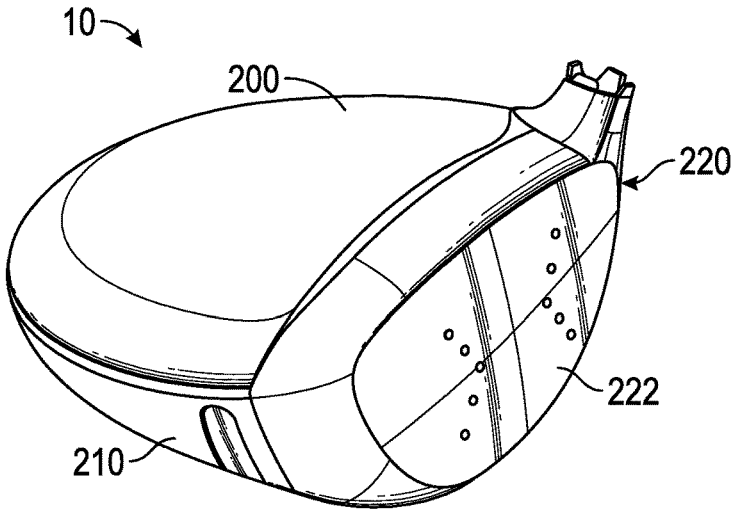
FIG. 12C is a fully assembled view of the embodiment shown in FIG. 12B.

In yet another embodiment, shown in FIGS. 12A-12C, conformal weights 40 are provided in the form of crown and sole shells 200, 210 that are affixed to a skeletal golf club head base 220. The base 220 comprises a striking face 222 and a support structure 225, composed of struts, that extends away from the striking face 222 and outlines the overall shape of the golf club head 10. The base 220, which preferably is composed of a structurally sound metal material such as titanium alloy or steel, provides a framework for the crown and sole shells 200, 210, which preferably are removably affixed to the base 220 so that additional, conformal weights 40 may be removably and/or adjustably placed in the interior cavity 230 of the golf club head 10 and thus hidden from view while the golf club head 10 is in use.

Figure 13:
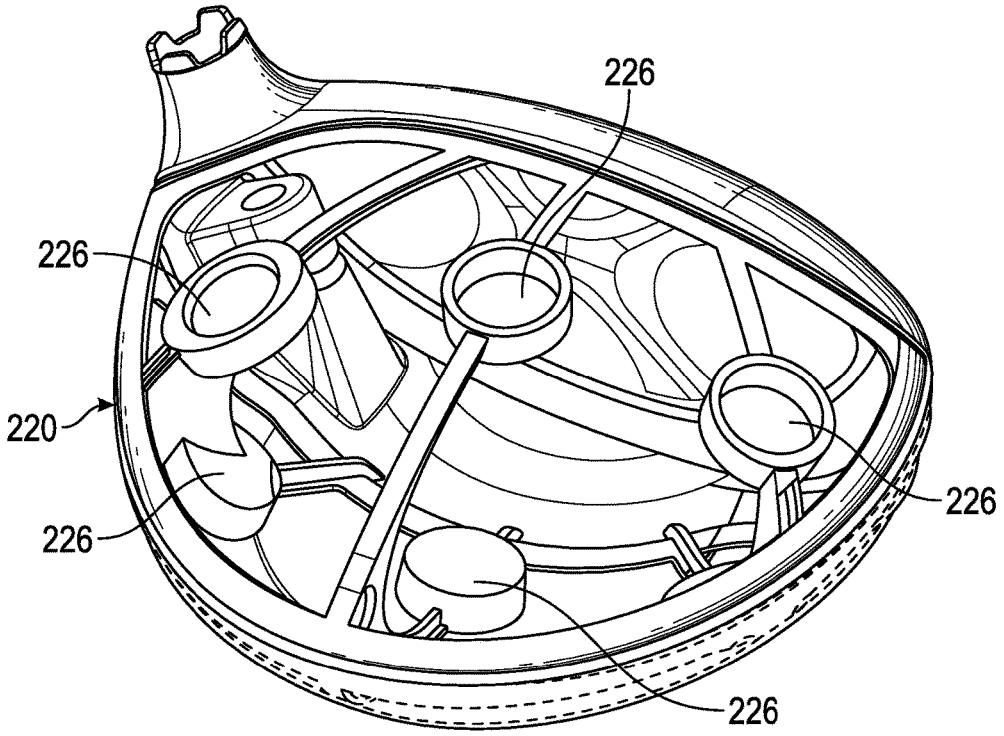
FIG. 13 is a top perspective view of another embodiment of a skeletal golf club head.
Figure 14:
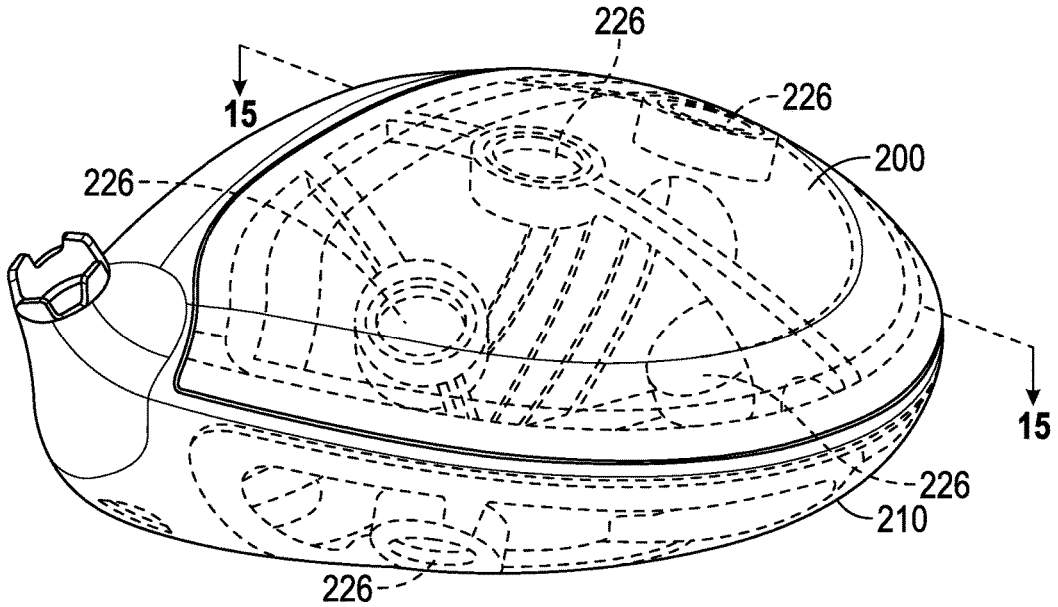
FIG. 14 is a side perspective view of the golf club head shown in FIG. 13 with crown and sole shells attached.
Figure 15:
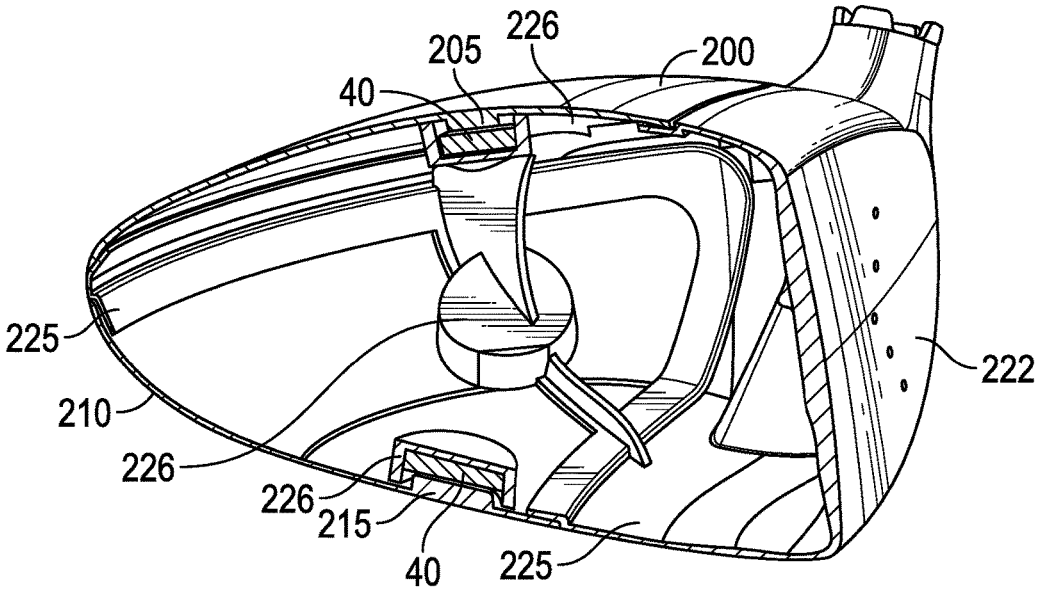
FIG. 15 is a cross-sectional view of the golf club head shown in FIG. 14 along lines 15-15.

For example, as shown in FIGS. 13-15, the support structure 225 includes a plurality of shallow weight ports 226 which are affixed to or integrally formed with the struts of the support structure 225 such that they are located in an internal cavity of the head proximate the crown and sole shells 200, 210 when those pieces are affixed to the base 220. One or both of the crown and sole shells 200, 210 can be made from a transparent or semi-opaque material such as plastic so that these weight ports 226, and any conformal weights 40 inside them, are visible to a player, as shown in FIGS. 14 and 15. In this embodiment, the crown and sole shells 200, 210 include protrusions 205, 215 extending from their respective internal surfaces that at least partially fill the upper and lower weight ports 226, respectively. One or more additional conformal weights 40 are trapped between the weight ports 226 and these protrusions 205, 215, and when the crown and sole shells 200, 210 are removed, these conformal weights 40 can be moved between weight ports 226 to adjust the overall mass properties of the golf club head 10. The crown and sole shells 200, 210 preferably are removably affixed to the skeletal golf club head base 220 with a screw fastener, such as those shown in FIG. 8 or in U.S. patent application Ser. No. 14/151,148, but in alternative embodiments may be affixed with a semi-permanent adhesive.

In another embodiment, the crown and sole shells 200, 210 may be combined with any of the conformal weights 40 disclosed herein. The skeletal nature of the base 220 removes material from the club head 10 and thus frees up mass to be used with weighting, including the conformal weights 40 and small weights 410, 420 disclosed herein.

For each of the embodiments disclosed herein, the conformal weights 40 may be disposed anywhere on or in the club head 10, including in or on external or internal surfaces of the crown 20, sole, 34, and face 32, and can be removably or permanently fixed in place with mechanical fasteners 41, permanent or semi-permanent adhesives, edge support structures 50, channels 60, or any other means known to a person skilled in the art. The conformal weights 40 disclosed herein may have their centers of gravity centered on the conformal weight 40, or disposed at one end or another to more dramatically affect center of gravity adjustability and bias, and all preferably are form fit with the golf club head's 10 outer mold line (OML) so as not to interfere with the golf club head's 10 aesthetics. In any of the embodiments disclosed herein, the conformal weights 40 can be separated from the other parts of the golf club head 10 with a damping layer 110.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A golf club head comprising:

a base structure comprising a striking face and a skeletal support structure extending away from the striking face;

a crown composed of a lightweight material; and a sole composed of the lightweight material, wherein the skeletal support structure comprises at least one shallow weight port, wherein at least one of the crown and the sole comprises a protrusion extending from an internal surface, wherein the protrusion at least partially fills the at least one shallow weight port, further comprising at least one conformal weight made from metal and is able to be moved to another port, and wherein the at least one conformal weight is secured within the at least one shallow weight port by the protrusion.

2. The golf club head of claim 1, wherein the at least one conformal weight is composed of a high-density metal alloy.

3. The golf club head of claim 1, further comprising a damping layer, wherein the damping layer is disposed between the at least one shallow weight port and the at least one conformal weight.

4. The golf club head of claim 1, wherein the at least one conformal weight comprises a polymer having a specific gravity value of 1.8 to 4.2.

5. The golf club head of claim 1, wherein the lightweight material is a composite material, and wherein the base structure is composed of a metal alloy.

6. The golf club head of claim 5, wherein the metal alloy is a titanium alloy.

7. The golf club head of claim 5, wherein the striking face is integrally cast with the skeletal support structure.

8. The golf club head of claim 1, wherein the at least one of the crown and the sole is removably affixed to the skeletal support structure.

9. The golf club head of claim 1, wherein the at least one shallow weight port is integrally formed with the skeletal support structure.

10. The golf club head of claim 1, wherein the shallow recess is disposed at a rear portion of the sole.

11. The golf club head of claim 1, wherein the golf club head is a wood-type golf club head.

12. The golf club head of claim 1, wherein at least one of the crown and the sole is transparent.

13. The golf club head of claim 12, wherein each of the crown and the sole is transparent.

14. The golf club head of claim 1, wherein at least one of the crown and the sole is affixed to the body with an adhesive.

* * * * *